United States Patent [19]

Herron, Jr.

[11] Patent Number: 4,970,753

[45] Date of Patent: Nov. 20, 1990

[54] VACUUM CLEANER NOISE REDUCING ARRANGEMENT

[75] Inventor: Roy H. Herron, Jr., Starr, S.C.

[73] Assignee: Ryobi Motor Products Corp., Pickens, S.C.

[21] Appl. No.: 484,059

[22] Filed: Feb. 23, 1990

[51] Int. Cl.[5] ..... A47L 9/00

[52] U.S. Cl. ..... 15/326; 15/327.2; 55/276

[58] Field of Search ..... 15/326, 327 R, 327 F; 55/276

[56] References Cited

U.S. PATENT DOCUMENTS

| | | | |
|---|---|---|---|
| 2,907,405 | 10/1959 | Marshall | 183/41 |
| 3,614,860 | 10/1971 | Grellsson | 15/326 X |
| 3,831,223 | 8/1974 | Colt et al. | 15/326 X |
| 4,356,591 | 11/1982 | Lude | 15/326 X |
| 4,617,034 | 10/1986 | Ikezaki et al. | 15/326 X |
| 4,864,683 | 9/1989 | Herron, Jr. et al. | 15/412 |

*Primary Examiner*—Chris K. Moore

*Attorney, Agent, or Firm*—David L. Davis

[57] ABSTRACT

An arrangement for reducing the noise generated by the exhaust air flow of a vacuum cleaner includes a two part cartridge internally formed with interleaved sets of baffle plates. This cartridge may be selectively installed within the vacuum cleaner housing in the exhaust air flow path, the housing being formed with an internal compartment adapted for receipt of the cartridge.

6 Claims, 3 Drawing Sheets

VACUUM CLEANER NOISE REDUCING ARRANGEMENT

BACKGROUND OF THE INVENTION

This invention relates to vacuum cleaners and, more particularly, to an arrangement for reducing the noise generated by the exhaust air flow of the vacuum cleaner.

In a vacuum cleaner, there are two primary sources of noise. The first primary source is noise due to mechanical vibration of the motor blower assembly and the second is noise generated by the exhaust air flow of the vacuum cleaner. It is a goal of the vacuum cleaner designer to reduce these noises to a minimum, in order to reduce as much as possible annoyance to an operator of the vacuum cleaner. An arrangement for reducing noise produced by mechanical vibration of the motor blower assembly is disclosed in U.S. Pat. No. 4,864,683, assigned to the assignee of the present invention, the contents of which are hereby incorporated by reference herein. In the drawings of the referenced patent, although not described nor claimed, there is shown a labyrinthine arrangement of walls formed as part of the housing which function to baffle the exhaust air flow so as to reduce the noise generated thereby. However, this particular arrangement has proven to be difficult to implement, due to molding constraints.

It is therefore a primary object of the present invention to provide a practical arrangement for reducing the noise generated by the exhaust air flow in a vacuum cleaner.

When designing a line of vacuum cleaners with different models having different features and selling for different prices, it is desirable for the sake of economy to have as much commonality of parts as possible among the various models. A desirable feature of a higher priced model is that it is quieter in operation than a lower priced model. Accordingly, it is a further object of this invention to provide a noise reducing arrangement as described above which may be selectively incorporated in different models while still retaining maximum commonality of parts.

SUMMARY OF THE INVENTION

The foregoing and additional objects are attained in accordance with the principles of this invention by providing a vacuum cleaner having a noise reduction compartment formed in its housing through which the exhaust air flow is caused to travel. A cartridge is provided for selective installation within the noise reduction compartment. The cartridge is arranged so that the exhaust air flow passes therethrough and is internally configured to interfere with the free flow of the exhaust.

In accordance with an aspect of this invention, the cartridge is a two part unit. Each part includes an array of parallel baffle plates which are interleaved with the array of baffle plates of the other part when the two parts are placed in juxtaposition to form a complete air flow baffle cartridge. The baffle plates cause the exhaust air flow to undergo a plurality of changes of direction, thereby removing energy from the air flow.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
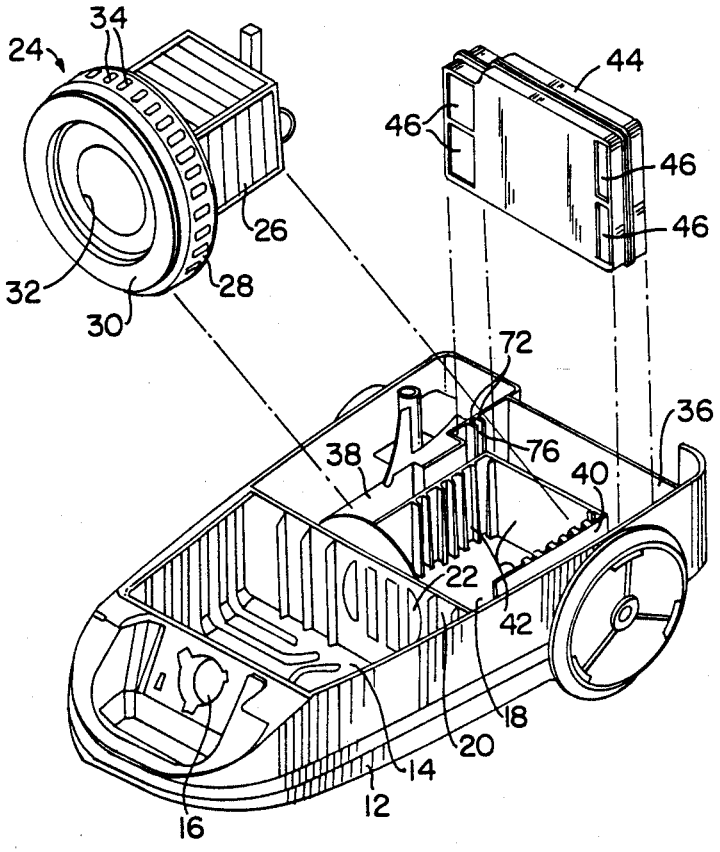
FIG. 1 is an exploded perspective view of a canister vacuum cleaner housing with the top cover removed, illustrating the present invention.

Referring now to the drawings, FIG. 1 shows a canister vacuum cleaner housing with the top cover removed. The housing lower portion 12 together with a top cover portion (not shown) form an enclosure for the components of the vacuum cleaner. The lower housing portion 12 has a plurality of walls which divide the enclosure into a plurality of compartments. One of the compartments is a dust collecting compartment 14 which typically includes provision for holding a disposable filter bag. As is well known, the dust collecting compartment 14 has an inlet opening 16 into which is inserted the end of a hose for admitting dirt laden air into the interior of the filter bag. A second compartment in the vacuum cleaner is a suction compartment 18 in which a motor blower assembly is mounted. The dust collecting compartment 14 and the suction compartment 18 are separated by a wall 20 having a plurality of apertures 22 within a defined region to allow air to pass from the dust collecting compartment 14 to the suction compartment 18. All of the foregoing is conventional in the vacuum cleaner art.

As is also conventional, suction for the vacuum cleaner is produced by a motor blower assembly 24 which includes an electric motor 26 connected to drive a fan within a casing 28. The fan within the casing 28 and the motor 26 are aligned longitudinally along the rotational axis of the motor 26. The casing 28 has a generally flat surface region 30 transverse to the motor axis at the end opposite the motor 26. An intake port 32 extends into the casing 28 through the surface region 30. A plurality of exhaust ports 34 extend into the casing 28 through a peripheral wall of the casing 28. Thus, in a conventional manner, the motor 26 drives the fan to create suction at the intake port 32, with the exhausted air leaving through the exhaust ports 34. The motor blower assembly 24 is illustratively mounted within the suction compartment 18 by an arrangement such as disclosed in the referenced patent.

Although not shown in the drawings, the top cover of the vacuum cleaner housing has a rear wall which includes an exhaust opening which communicates with the suction compartment 18. This exhaust opening may be arranged to be of the same configuration as the inlet opening 16 so that an end of a hose can be inserted therein for alternate use of the vacuum cleaner as a blower.

According to this invention, a noise reduction compartment 36 is formed within the housing lower portion 12. The noise reduction compartment 36 communicates with the housing exhaust port and passageways 38 and 40 are also formed in the housing lower portion 12 to provide air flow communication between the suction compartment 18 and the noise reduction compartment 36. As is shown in the drawings, the noise reduction compartment 36 and the passageways 38 and 40 are illustratively formed by providing a U-shaped wall structure 42 within the space making up the suction compartment 18.

Figure 2:
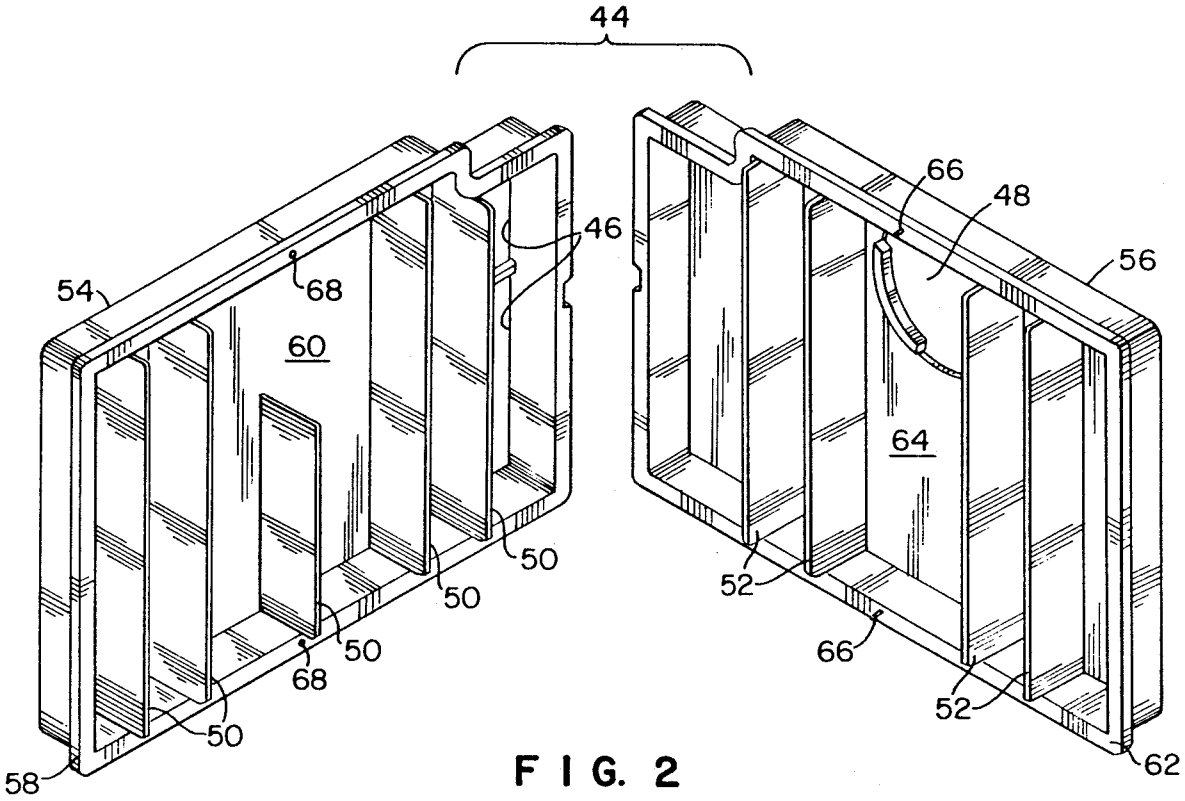
FIG. 2 is a perspective view showing the two parts of an air flow baffle cartridge according to this invention.

To provide noise reduction on a selective basis, an air flow baffle cartridge 44 is removably supported within the noise reduction compartment 36. The cartridge 44 includes openings 46 for communicating with the passageways 38, 40, and an opening 48 for communicating with the housing exhaust opening. Illustratively, as shown in FIG. 2, the opening 48 may be configured to accept therein the end of a hose. Between the openings 46 and the opening 48, the cartridge 44 is arranged to interfere with the free flow of air. In particular, baffle plates 50, 52 are within the cartridge 44 to cause the flow of air from the openings 46 to the opening 48 to undergo a plurality of changes of direction. As is well known, causing a flow of air to change direction removes energy from the air flow and results in a reduction of the noise generated thereby.

As shown in FIG. 2, the cartridge 44 includes a two part housing member 54, 56 forming an enclosure. The first part 54 has an open side surrounded by an outwardly extending flange 58, and a wall 60 opposite that open side. Likewise, the second housing member part 56 includes an open side surrounded by an outwardly extending flange 62 and a wall 64 opposite the open side. The wall 60 has the openings 46 formed therein and the wall 64 has the opening 48 formed therein. Preferably, the open sides of the housing member parts 54 and 56 are planar and the flanges 58 and 62 extend within the plane defined by the open sides of the respective housing member parts. Thus, when the housing member parts 54, 56 are juxtaposed along their open sides, the flanges 58 and 62 abut and the two parts 54, 56 together form the air flow baffle cartridge 44.

Figure 3:
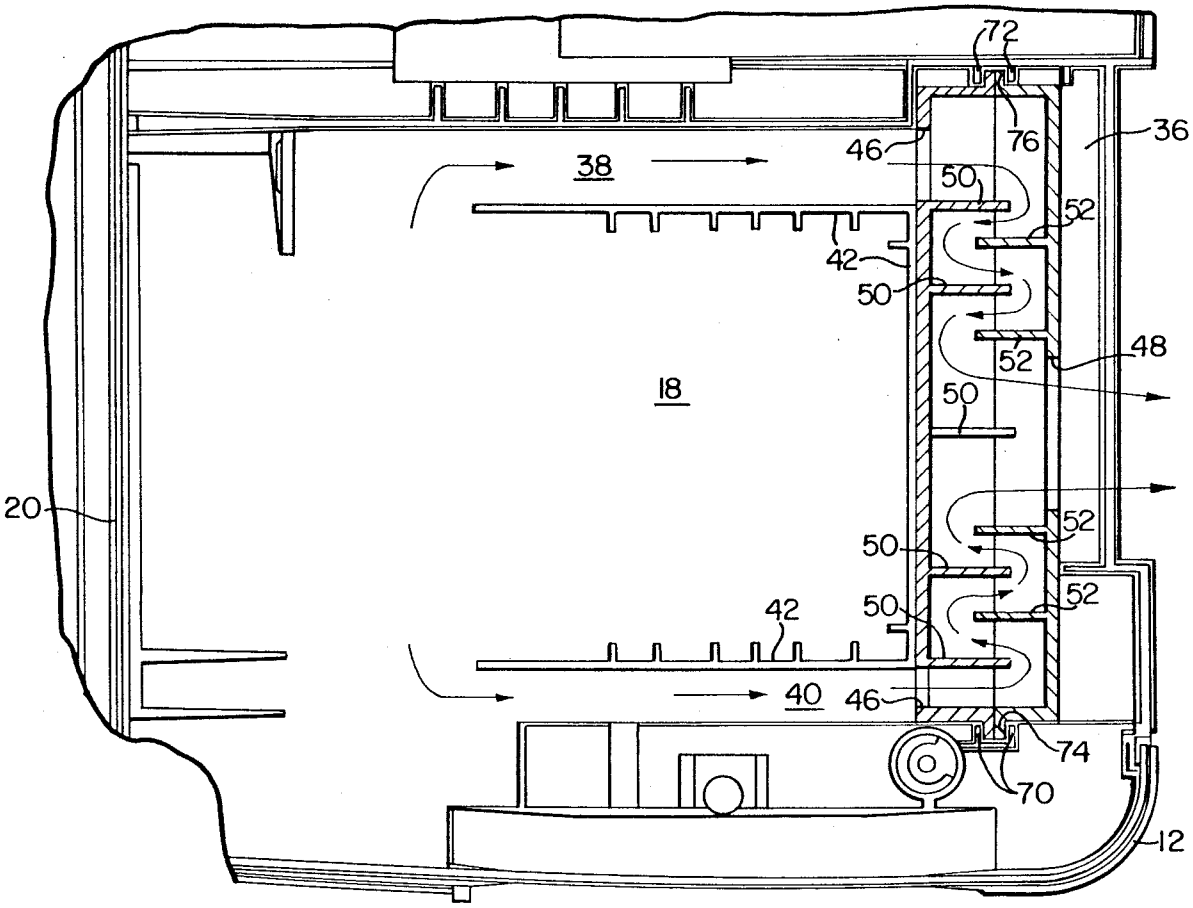
FIG. 3 is a top plan view of the lower housing of the canister vacuum cleaner shown in FIG. 1 with a cross-section through the air flow baffle cartridge and illustrating the exhaust air flow path.

As is shown in the drawings, the first set of baffle plates 50 extend from the wall 60 in parallel spaced relationship beyond the plane of the open side of the first housing member part 54 and are substantially orthogonal to that plane. The extension of the plates 50 beyond the open side plane is dimensionally less than the depth of the second housing member part 56. Likewise, the second set of baffle plates 52 extends from the wall 64 in parallel spaced relationship beyond the plane defined by the open side of the second housing member part 56 and are substantially orthogonal to that plane. The extension of the plates 52 beyond the open side plane is dimensionally less than the depth of the first housing member part 54. When the housing member parts 54 and 56 are juxtaposed along their open sides to form the cartridge 44, the first and second sets 50, 52 of baffle plates are interleaved, leaving spaces between the distal ends of the plates 50 and the wall 64 and between the distal ends of the plates 52 and the wall 60. Accordingly, as is clear from FIG. 3, the flow of air from the openings 46 to the opening 48 is caused to be along a convoluted path, changing its direction a multiplicity of times.

To assist in aligning the housing member parts 54 and 56 when they are placed in juxtaposition, the flanges 58 and 62 are formed with complementary locating projections 66 and locating cavities 68. These locating elements are so situated and configured on the flanges 58, 62 that when the parts 54, 56 are properly juxtaposed, the projections 66 enter corresponding cavities 68 so that the flanges 58, 62 are properly abutting one against the other.

By providing a two part cartridge as described, molding of the baffle plates 50, 52 is effected in a practical manner. Thus, each of the housing member parts 54, 56 is preferably a unitary molded plastic part integrally formed with its respective set of baffle plates 50, 52.

The vacuum cleaner housing 12 is further formed with a pair of parallel spaced apart substantially vertical ribs 70 on one side of the noise reduction compartment 36, and another pair of parallel spaced apart substantially vertical ribs 72 on the opposite side of the noise reduction compartment 36. The spaces between the sets of ribs 70, 72 form a pair of channels 74, 76, respectively, into which the flanges 58, 62 are inserted when the cartridge 44 is installed in the noise reduction compartment 36. This holds the parts 54, 56 together to maintain the integrity of the cartridge 44.

Accordingly, there has been disclosed an arrangement for reducing the noise generated by the exhaust air flow of a vacuum cleaner. It will be appreciated that this arrangement may be selectively provided in different models of a line of vacuum cleaners while preserving maximum commonality of parts. While a preferred embodiment of the present invention has been disclosed herein, it will be apparent to those of ordinary skill in the art that various modifications and adaptations to that embodiment are possible and it is only intended that the present invention be limited by the scope of the appended claims.

I claim:

1. In a vacuum cleaner having:

a housing forming an enclosure for the components of the vacuum cleaner, an inlet opening formed in said housing for communicating between the ambient atmosphere and the interior of said housing, and an exhaust opening formed in said housing for communicating between the interior of said housing and the ambient atmosphere; and an electric motor blower assembly including a fan and a motor mounted in said housing, said fan being enclosed within a casing including an intake port and an exhaust port, said motor driving said fan to create suction at said intake port to set up a flow of air from said inlet opening to said exhaust opening;

an arrangement for baffling the flow of air between said fan casing exhaust port and said housing exhaust opening so as to reduce the noise generated by said flow of air, comprising:

a noise reduction compartment formed in said housing and communicating with said housing exhaust opening;

means for providing air flow communication between said fan casing exhaust port and said noise reduction compartment; and an air flow baffle cartridge removably supported within said noise reduction compartment, said cartridge having a first opening for communicating with said air flow communication providing means, a second opening for communicating with said housing exhaust opening, and means intermediate said first and second cartridge openings for interfering with the free flow of air therebetween.

2. The arrangement according to claim 1 wherein said cartridge includes a housing member forming an enclosure and said interfering means includes a plurality of baffle plates within said enclosure for directing air flow from said first cartridge opening to said second cartridge opening along a path which causes the flow of air to undergo a plurality of changes of direction.

3. The arrangement according to claim 2 wherein said cartridge housing member includes a first housing part and a second housing part, each of said first and second housing parts having an open side and a wall opposite said open side, said first housing part including a first set of baffle plates extending in parallel spaced relationship from said first housing part wall toward said first housing part open side, said second housing part including a second set of baffle plates extending in parallel spaced relationship from said second housing part wall toward said second housing part open side, said first and second sets of baffle plates together constituting said plurality of baffle plates and so configured as to be interleaved when said first and second housing parts are juxtaposed along said open sides to form said cartridge enclosure, said first housing part wall having said first cartridge opening formed therein, said second housing part wall having said second cartridge opening formed therein.

4. The arrangement according to claim 3 wherein said first and second housing parts are juxtaposed along a plane and each of the baffle plates in said first and second sets of baffle plates extends from its respective housing part wall beyond said plane and substantially orthogonal thereto, the extensions of the plates of each housing part beyond said plane being dimensionally less than the depth of the other housing part.

5. The arrangement according to claim 4 wherein each of said first and second housing parts is formed with an outwardly extending flange surrounding its respective open side and said noise reduction compartment is formed with a channel into which the housing part flanges are inserted so as to hold said housing parts together.

6. The arrangement according to claim 5 wherein one of said housing parts is formed with at least one locating projection on its respective flange and the other of said housing parts is formed with at least one locating cavity on its respective flange, said locating projection and said locating cavity being so configured and situated on said flanges to assist in aligning said housing parts in juxtaposition to form said enclosure.

* * * * *